United States Patent [19]

Kaspar

[11] 4,106,609

[45] Aug. 15, 1978

[54] REMOVABLE FRONT PANEL

[75] Inventor: Don G. Kaspar, Shiner, Tex.

[73] Assignee: Kaspar Wire Works, Inc., Shiner, Tex.

[21] Appl. No.: 736,166

[22] Filed: Oct. 27, 1976

[51] Int. Cl.[2] ..... G07F 5/02

[52] U.S. Cl. ..... 194/1 B; 221/154; 312/35

[58] Field of Search ..... 194/1 G, 1 K, 54, 51, 194/57-59, 60, 68, 71, DIG. 2; 126/194; 312/35; 221/125, 129, 154, 155, 281, 282; 292/148, 300, 302, 281-286; 70/2-4

[56] References Cited

U.S. PATENT DOCUMENTS

| | | | |
|---|---|---|---|
| 716,118 | 12/1902 | Scott | 292/281 X |
| 1,005,382 | 10/1911 | Webster | 194/59 |
| 1,168,066 | 1/1916 | Girosdot | 292/281 X |
| 1,281,410 | 10/1918 | Miller | 221/155 X |
| 2,738,049 | 3/1956 | Shepherd | 221/282 X |
| 3,286,706 | 11/1969 | Hoppe | 126/194 |
| 3,374,020 | 3/1968 | Berg | 292/148 X |
| 3,450,125 | 6/1969 | Hopkins | 126/194 X |
| 3,905,530 | 9/1975 | Emmel | 221/155 |
| 3,940,016 | 2/1976 | Krakauer | 221/129 |

*Primary Examiner*—Stanley H. Tollberg
*Assistant Examiner*—Fred A. Silverberg
*Attorney, Agent, or Firm*—Stein & Frijouf

[57] ABSTRACT

An easily removable front panel for a newspaper vending machine uniquely containing the dispensing door with the customary display window, the coin mechanism and the coin return means. Easy access is provided not only for adjustment or repair of the coin mechanism and for coin removal, but also to the newspaper storage cavity of the cabinet for reloading.

7 Claims, 6 Drawing Figures

FIG. 1
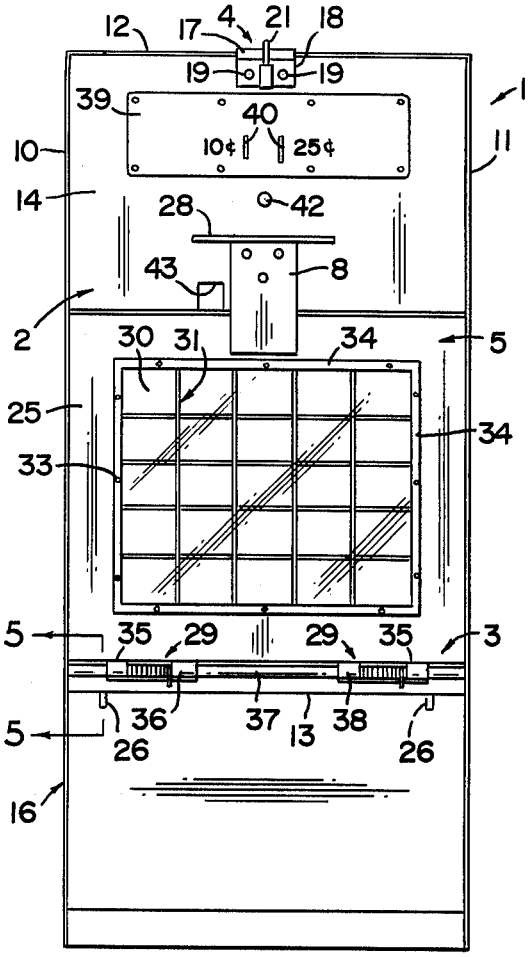
FIG. 2
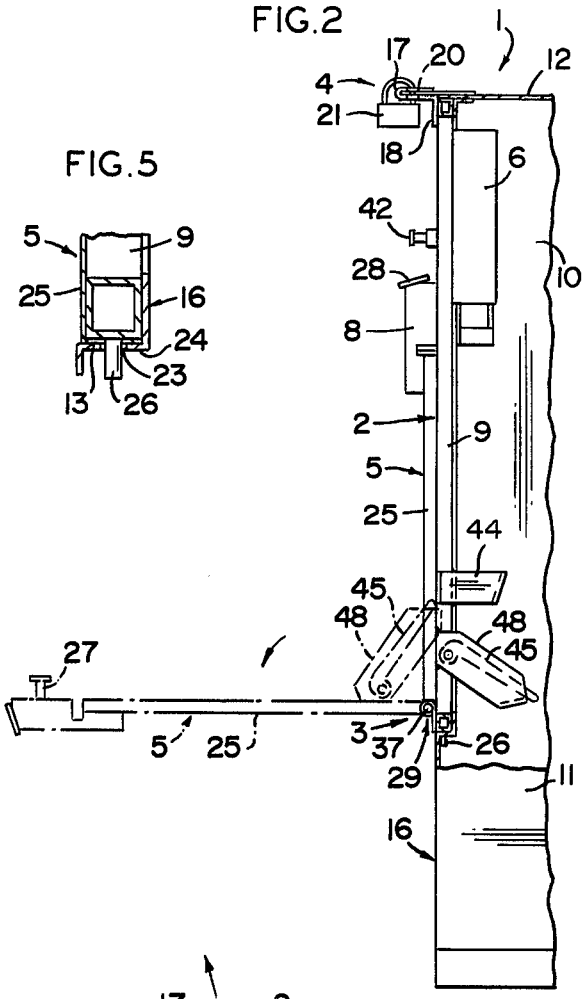
FIG. 5
FIG. 4
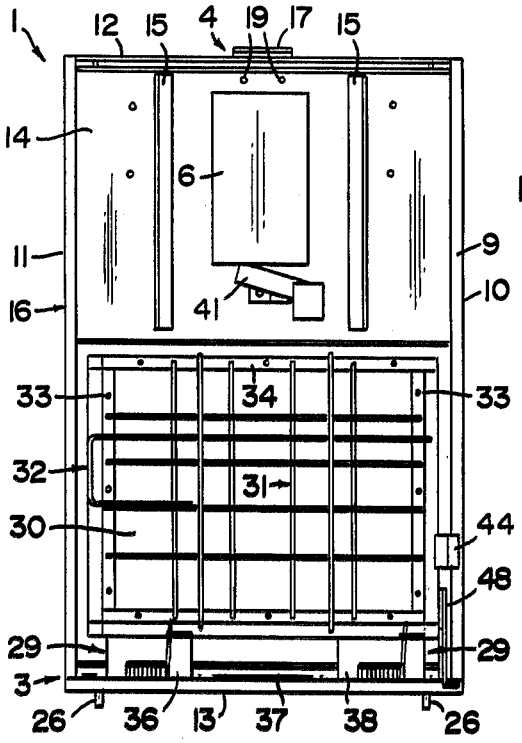
FIG. 3
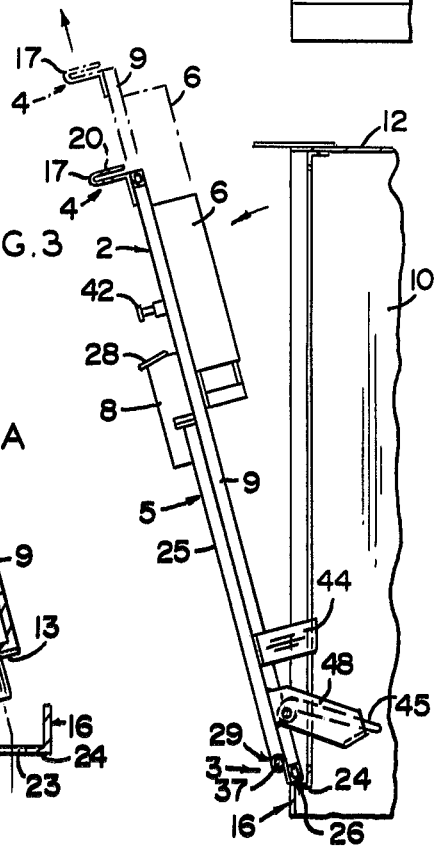
FIG. 5A
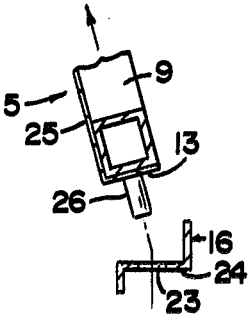

REMOVABLE FRONT PANEL

BACKGROUND OF THE INVENTION

1. Field of the Invention

This invention relates to an easily removable front panel for a newspaper vending machine. The panel contains the dispenser door, the coin mechanism and the coin return slot whereby easy access is possible to the main operating parts of the machine.

More particularly, the invention here involves a front panel which is easily removable by simply unlocking it from the cabinet of the newspaper vending machine, tilting it forward and lifting it out. The panel contains on its backside, the coin mechanism, the latch for the dispenser door as well as the coin return means. When removed there is easy access to such operating mechanism and to the coin box for coin collection and to the newspaper storage cavity for refilling.

2. Description of the Prior Art

There presently exists many types of front panels for dispensing machines. Some are permanently fastened to the cabinet while others are semi-permanently fastened.

The panel may support some of the mechanism required for dispensing. Unfortunately, if the panel or the mechanism requires adjustment or repair, the entire machine must usually be transported to the repair shop and where the front panel contains the dispenser door, usually the only accessibility is through that. Such is seen in U.S. Pat. Nos. 2,922,756; 3,023,928; 3,180,518; 3,225,961 and 3,536,231. Where the panel is semi-permanently fastened as seen in U.S. Pat. Nos. 826,207, 2,738,049 and 3,225,961, the dispensing mechanism is still contained in the cabinet, making repair difficult. Thus, there is a need for improvement in structure and in function.

An object of this invention is to provide such a front panel for the cabinet of a vending machine.

Another object is to provide a panel which supports the dispensing door of the vending machine so that the door may be removed with the panel giving improved access to the interior of the cabinet, the coin mechanism and the latch means for the dispensing door.

A further object is to provide a panel with a dispensing door having pivot limit means to avoid damage during reloading.

A still further object is to provide a panel with simplified lock means to the cabinet.

Other objects of the invention will in part be obvious and will in part appear hereinafter.

SUMMARY OF THE INVENTION

A removable front panel has now been designed to function as the front of a newspaper vending machine. The machine is one particularly designed for dispensing periodicals such as newspapers and magazines after a customer has deposited a predetermined amount of money into the coin mechanism. Since the panel is removably fastened to the machine, the repair, service, refill and adjustment functions, always necessary with such machines, is easily performed. Easier access to the machine's mechanism is provided. And in the worst case, a substitute panel may be easily substituted for the broken panel. Needed adjustments such as price changes can be more easily made and the paper boy can more quickly and easily refill the machine therefore reducing the total time it takes to run his route.

The removability is accomplished by two pegs on the bottom of the panel which enter mating apertures located on the lower portion of the vending machine. Panel lock means at the upper portion of the panel lock the panel in a closed position.

In use, the operator unlocks the panel lock means, pivots the panel toward himself and then lifts the panel out, thereby freeing the pegs from their mating orifices. The machine can then be reloaded with newspapers and the panel replaced and locked or else the various mechanisms on the back of the panel can be repaired or replaced.

To dispense newspapers, the customer inserts coins in the coin slot on the panel and opens the dispensing door. The latch of the door is opened by a coin mechanism such as disclosed in U.S. Pat. No. 3,738,466. Such action releases the dispenser door means therefore allowing the customer access to the periodicals contained in the vending machine.

The invention accordingly comprises the features of construction, combination of elements, and arrangement of parts which will be exemplified in the construction hereinafter set forth, and the scope of the invention will be indicated in the claims.

For a fuller understanding of the nature and objects of the invention, reference should be had to the following detailed description taken in connection with the accompanying drawing.

BRIEF DESCRIPTION OF THE DRAWINGS

FIG. 1 is a front view of the removable front panel.

FIG. 2 is a cross-sectional side view of the panel of FIG. 1 with the dispensing door shown in its fully open position.

FIG. 3 is a cross-sectional side view showing the panel in a partially open position.

FIG. 4 is a rear view of the panel.

FIG. 5 is a partial sectional view along lines 5—5 of FIG. 1 showing one of the pegs in its mating orifice.

FIG. 5A is a partial sectional view showing the peg removed from the orifice.

Similar reference characters refer to similar parts throughout the several views of the drawing.

DETAILED DISCUSSION

As seen best in FIG. 1 the subject invention is particularly configured to be used as the front panel of a newspaper vending machine 1. Front panel 2 includes a panel pivot means 3 and a panel lock means 4. The panel supports a dispensing means 5 and a coin mechanism 6 and a latch 8 for the mechanism.

The structure of the panel consists of an outer support frame 9 (FIG. 4) with a left side 10 and right side 11, a top 12 and a bottom 13. The frame has a planar covering 14 and vertical strengthening supports 15. The support frame 9 fits within the newspaper vending machine cabinet 16.

The planar covering 14 supports an informative plate 39 (FIG. 1) on its outer side and has coin slots 40 contained therein. A coin return button 42 operates the mechanism 6, in conjunction with a coin return slot 43.

As best seen in FIG. 3, the panel lock means 4 of the front panel 2 comprises a U-shaped bracket 17 including a panel securing plate 18 connected to the upper portion of the panel by screw means 19 (see FIGS. 1 and 2). The U-shaped bracket 17 fits over the edge of the upper portion of cabinet 16. The legs of the U-shape of bracket 17 each have a hole 20 to receive a padlock 21. Obviously other panel lock means could be utilized.

As best seen in FIGS. 1, 5 and 5A, the panel pivot means 3 comprises two pegs 26 secured to the bottom 13 of the frame 9 and two mating apertures 23 located in the lower portion 24 of the cabinet 16.

The dispensing means 5 comprises a newspaper dispenser door 25, hinges 29 and a latch 27. The dispenser door has a handle 28, a transparent display window 30 and a window guard 31 to protect the transparent window 30 and a wire newspaper display support 32 to hold a newspaper against the transparent window 30 in a displaying position. The transparent window 30 and the wire display support 32 are fastened to the dispenser door 5 by retainer 33 which surrounds the periphery of the window and is connected to the dispenser door by a plurality of screws 34.

The hinge 29 is of the spring-hinge type and comprises two leafs 35 securely connected to the lower portion of the dispenser door 25 and the lower frame 13. A spring-loaded hinge pin 37 hingedly connects the first leaf 36 and the second leaf 38 together.

The latch 27 locks the dispenser door 25 in a closed position. In its preferred embodiment, it is an integral component of the coin mechanism 6. The coin mechanism is preferably removably connected to panel 2 by a lug means 41.

The coin mechanism 6 may be any conventional coin mechanism constructed to release the dispenser door upon the insertion of a predetermined amount of coins into the coin slots 40.

To remove the panel 2 from the cabinet 1, the operator merely unlocks padlock 21 and then pivots the panel until a panel stop arm 44 stops such movement. The panel stop arm 44 comprises a body portion and an L-shaped inner portion which, upon opening of the panel rack 2, catches the side frame 10. Such limiting action prevents pegs 26 from binding in their apertures 23 when in the open position as shown in FIG. 3. After pivoting, the operator simply lifts the panel 2 upward which frees the pegs 26 from their apertures 23 thereby completely releasing the rack 2 from cabinet 1.

To operate, the customer merely inserts a predetermined amount of coins into the coin slots 40 which guide the coins into the coin mechanism 6, which then opens the latch 27. By pulling the handle means 28, dispenser door 25 is opened. Door stop arm 48 limits the extent of movement of the dispenser door 25. Prop lever 45 may be pivotally secured to said door stop arm 48. Thus, when the dispenser door 25 is opened and the prop lever 45 is pivoted into propping position, the dispensing door 25 is kept open so that the machine can be refilled in the conventional manner. The machine 1 may also be filled by totally removing the panel 2. After the customer has received the item, the spring-loaded hinge pin 37 automatically pivots, forcing the dispenser door 25 back into its closed position.

As should now be evident, the most obvious advantage of the subject invention is the ease of serviceability of the vending machine. Since the dispensing means and the coin mechanism are usually the most complicated components of the vending machine, support on the back side of the panel makes for easy accessbility. Any malfunction of these main operating elements can be easily remedied by mere substitution of another panel. As a result the vending machine remains operational while the malfunction panel is taken to the repair shop to be repaired.

In similar fashion, the panel can be removed to allow access to the various operating elements for onthespot repair or servicing.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

Now that the invention has been described, what is claimed is:

1. A vending machine, comprising in combination:
a cabinet having a removable front panel;
a dispenser door hingedly connected to said panel;
a coin mechanism and a latch mounted to said panel for releasing said latch upon insertion of a predetermined amount of coins into said coin mechanism to enable the opening of said dispenser door;
pivot means including a peg secured in a fixed relation to one of said front panel and said cabinet and positioned to be removably inserted into a corresponding aperture located in the other of said front panel and said cabinet;
said peg being pivotable in said aperture enabling said front panel to be pivoted forward and removed from said cabinet;
panel lock means comprising a projecting portion having an aperture and extending from one of said front panel and said cabinet of the vending machine; and
an aperture in the other of said front panel and said cabinet and established to be coincident with said aperture in said projecting portion when said front panel is in the closed position enabling a padlock to be inserted through said apertures to lock said front panel the said cabinet.

2. The removable front panel of claim 1, wherein said projecting portion comprises a U-shaped projecting portion connected to said panel for extending over an edge of said cabinet of the vending machine.

3. The removable front panel of claim 1, wherein said peg is connected to the bottom of said front panel and positioned to be inserted into an aperture located in the cabinet.

4. The removable front panel of claim 1 wherein said peg extends in a substantially vertical direction.

5. The removable front panel of claim 1 wherein said dispenser door has a display window and a door stop means to limit the opening stroke of the dispenser door.

6. The removable front panel of claim 1 comprising a panel stop arm which limits the pivot action of said panel from the vending machine.

7. A vending machine, comprising in combination:
a cabinet having a removable front panel;
a dispenser door hingedly connected to said panel;
a coin mechanism and a latch mounted to said panel for releasing said latch upon insertion of a predetermined amount of coins into said coin mechanism to enable the opening of said dispenser door;
pivot means including a peg secured in fixed relation to one of said front panel and said cabinet and positioned to be removably inserted into a corresponding aperture located in the other of said front panel and said cabinet;

said projection being pivotable in said aperture enabling said front panel to be pivoted forward about one end of said front panel and removed from said cabinet; and panel lock means coacting between said cabinet and the other end of said front panel enabling said pivot means and said panel lock means to secure opposed ends of said front panel to said cabinet when said panel lock means locks said front panel to said cabinet.

* * * * *